US006048917A

United States Patent [19]

Hammer et al.

[11] Patent Number: 6,048,917

[45] Date of Patent: Apr. 11, 2000

[54] CELLULOSE BONDED NONWOVEN FIBER FABRIC AND METHOD FOR THE PRODUCTION THEREOF

[75] Inventors: Klaus-Dieter Hammer, Mainz; Gerhard Grolig, Moerfelden-Walldorf, both of Germany

[73] Assignee: Kalle Nalo GmbH & Co. KG, Wiesbaden, Germany

[21] Appl. No.: 09/147,834

[22] PCT Filed: Sep. 10, 1997

[86] PCT No.: PCT/EP97/04941

§ 371 Date: Mar. 16, 1999

§ 102(e) Date: Mar. 16, 1999

[87] PCT Pub. No.: WO98/11288

PCT Pub. Date: Mar. 19, 1998

[30] Foreign Application Priority Data

Oct. 18, 1996 [DE] Germany ..... 196 37 621

[51] Int. Cl.[7] ..... B32B 5/02; B32B 27/04; B32B 27/12; D04H 1/00; D04H 3/00

[52] U.S. Cl. ..... 524/36; 442/63; 442/327; 442/414; 426/77; 426/138

[58] Field of Search ..... 442/63, 327, 414; 426/77, 138; 524/36

[56] References Cited

U.S. PATENT DOCUMENTS

| | | | |
|---|---|---|---|
| 3,135,613 | 6/1964 | Underwood | 99/176 |
| 3,484,256 | 12/1969 | Chiu et al. | 99/171 |
| 4,246,221 | 1/1981 | McCorsley, III | 264/203 |
| 4,868,227 | 9/1989 | Kempter et al. | 523/222 |
| 5,824,115 | 10/1998 | Kubota et al. . | |

FOREIGN PATENT DOCUMENTS

| | | |
|---|---|---|
| 0 281 083 | 9/1988 | European Pat. Off. . |
| 0 281 921 | 9/1988 | European Pat. Off. . |
| 1091105 | 2/1966 | United Kingdom . |
| 2 146 673 | 4/1985 | United Kingdom . |
| 92/08835 | 5/1992 | WIPO . |

*Primary Examiner*—Nathan M. Nutter
*Attorney, Agent, or Firm*—Foley & Lardner

[57] ABSTRACT

The invention relates to a bonded nonwoven fiber fabric and packaging films strengthened with such a fabric, especially sausage casings based on celluloses. The nonwoven fiber fabric itself can be used as teabag paper. Bonding is achieved through treatment of a solution comprising cellulose, N-methylmorpholime-N-oxide and water. Bonding can be strengthened by a polyamine polyamide epichlorohydrin resin added to the fibrous pulp.

14 Claims, No Drawings

CELLULOSE BONDED NONWOVEN FIBER FABRIC AND METHOD FOR THE PRODUCTION THEREOF

This application claims benefit of priority under 371 for PCT/EP97/04941, filed Sep. 10, 1997.

The invention relates to a cellulose-bonded nonwoven fiber fabric and a process for the production thereof. It further relates to the use of this nonwoven fiber fabric for the production of food packaging, in particular teabags or sausage casings.

Fiber-reinforced seamless cellulose casings are usually produced by the viscose process. In this process, a nonwoven fiber fabric, for example made of hemp fiber paper, which has been formed into a tube is coated on the inside and/or outside with an alkaline viscose solution. The material coated on the inside, outside or both with viscose thus produced is then treated with an acidic coagulation liquid which precipitates the cellulose xanthogenate and regenerates it to form cellulose hydrate. Generally, enough viscose solution is applied to cover the nonwoven fiber fabric completely on one or both sides with a layer of regenerated cellulose. Fiber-reinforced cellulose casings are very widely used as sausage casings.

It is also known to coat with viscose flat webs made of a nonwoven fiber fabric. In this process, the viscose-coated material is coagulated in the manner described and regenerated. The fiber-reinforced cellulose flat films may likewise be processed into tubular casings if they are appropriately bent and the edges sewed together, glued or sealed. Such casings are also suitable as sausage casings.

The nonwoven fiber fabric is produced in a usual manner from cellulose fibers. To increase its strength, it is generally bonded. Thus U.S. Pat. No. 3,135,613 discloses the production of a wet-strength hemp fiber paper. The increased strength is achieved by treatment with a dilute alkaline viscose solution, drying and regeneration of the cellulose using dilute sulfuric acid. The paper is then washed until it is acid-free and is finally dried. The regenerated cellulose coating serving as bonding is so thin that the porous structure of the paper is retained.

However, a pure cellulose bonding is not sufficiently alkali-resistant and stable to hydrolysis. During a subsequent coating of the paper with alkaline viscose solution, the existing cellulose again partially dissolves and the fibers loosen. Tubular films having a fiber reinforcement of this type therefore have a tendency to burst, even at a low internal pressure.

To avoid this disadvantage, nonwoven fiber fabrics have also been used which are set solely with synthetic resins. According to GB-A 1 091 105, the cellulose fibers are bonded with an alkali-curable resin, for example a polyethyleneimine resin or an epichlorohydrin-crosslinked polyamide. In U.S. Pat. No. 3,484,256, for this purpose use is made of a mixture of a cationic heat-curable resin and a polyacrylamide. Cellulose casings reinforced with this material do not guarantee the bursting strength which is demanded for certain sausage types.

Resin bonds are generally not sufficiently heat stable. The viscose solution can in addition not penetrate resin-bonded nonwoven fiber fabrics sufficiently. Furthermore, the resin causes the regenerated cellulose to adhere insufficiently to the fibers.

The object of the invention is to provide in an environmentally compatible manner a nonwoven fiber fabric which has wet strength, is alkali- and hydrolysis-resistant, is optimally penetrated by the viscose and bonds firmly to regenerated cellulose hydrate. In particular, the tubular food casings produced therefrom by viscose-coating are to have an optimum strength, extensibility and swellability, as well as a good shrinkage behavior.

This object is achieved by a nonwoven fiber fabric whose fibers were bonded by a) treatment with a solution of cellulose in a mixture of N-methylmorpholine N-oxide (NMMO) and water,
b) precipitation of the cellulose using an aqueous NMMO solution,
c) washing to remove the NMMO and, if appropriate,
d) drying.

The nonwoven fiber fabric can, as is customary, be produced by running a screen through a fiber pulp and then partially or completely drying the resultant nonwoven fiber fabric. The fiber pulp preferably comprises from about 0.1 to 2% by weight of cellulose fibers, hemp fibers being preferred. Other constituents, such as resins or sizes, can also be further added to the fiber pulp. The nonwoven fiber fabric can also be impregnated or coated, preferably likewise with resins or sizes.

In a particularly preferred embodiment, a polyamine-polyamide-epichlorohydrin resin (also called polyamidoamine-epichlorohydrin resin), a urea-formaldehyde resin, a melamine-formaldehyde resin or a urea-melamine-formaldehyde resin is added to the fiber pulp. The amount of this resin is preferably from 0.5 to 2% by weight, based on the total weight of the fiber pulp. The resin migrates during drying to the points of intersection of the fibers and reacts during curing with the fibers and also with itself. This further increases the stability.

The nonwoven fiber fabric according to the invention comprises from about 0.5 to 9% by weight, preferably from 1 to 3% by weight, particularly preferably from 1.5 to 2% by weight, of cellulose based on its total weight. It is already usable as such, e.g. to produce teabags therefrom. It then preferably has a weight of from about 8 to 20 g/m$^2$. However, particularly advantageously, it may be viscose-coated and processed to form fiber-reinforced food casings. It then preferably has a weight of from 12 to 30 g/m$^2$, particularly preferably from 15 to 28 g/m$^2$.

The invention thus also relates to a fiber-reinforced food casing or packaging film produced by the viscose process, wherein the fiber reinforcement consists of the nonwoven fiber fabric according to the invention. It is principally used as sausage casing.

The invention also includes a process for producing the nonwoven fiber fabric according to the invention, which comprises the following stages in the sequence specified:

providing a suspension which comprises cellulose fibers and preferably, in addition, at least one polyamine-polyamide-epichlorohydrin resin,
forming a nonwoven fiber fabric from the suspension (e.g. by filtering off through an inclined screen),
partial or complete drying of the nonwoven fabric,
applying a solution of cellulose in NMMO/water to the nonwoven fabric,
precipitating the cellulose using an aqueous NMMO solution,
washing the nonwoven fabric (generally with water) until the nonwoven fabric is virtually free of NMMO and
drying until the desired degree of residual moisture is reached.

Treatment with the cellulose/NMMO/water solution preferably takes place by immersion into a corresponding bath.

The cellulose/NMMO/water solution preferably comprises from about 0.5 to 2.0% by weight of cellulose, based on its total weight. The NMMO/water mixture used as solvent preferably consists of from 85 to 90% by weight of NMMO and from 15 to 10% by weight of water. The preparation of cellulose/NMMO/water solutions is also described in DE-A 196 07 953.

The aqueous NMMO solution used for the precipitation preferably comprises from about 5 to 15% by weight of NMMO, particularly preferably about 10% by weight of NMMO, based on its total weight.

The nonwoven fiber fabric according to the invention optimally complies with the objects set. In particular, it shows a higher wet strength and dry strength. In addition, it has the desired porous surface structure. The cellulose applied from NMMO solution by the process according to the invention is more compact, denser and more crystalline (from 55 to 65% crystalline fraction) than that applied by the viscose process (from 34 to 42% crystalline fraction). It is therefore markedly less attacked during a subsequent coating by viscose solution or other alkaline solutions. This is another advantage of the nonwoven fiber fabric according to the invention.

At least as important as the higher crystallinity is the fact that the nonwoven fiber fabrics according to the invention may be produced simply. In contrast to the viscose process, no exhaust air or waste water problems occur during production. The NMMO is approximately 99.5% recovered in the process.

To produce a packaging film or food casing, webs of the nonwoven fiber fabric according to the invention are viscose-coated on one or both sides. Seamless tubular films or casings may be obtained by bending the webs of the nonwoven fiber fabric to form a tube and impregnating and coating them on the outside and/or inside with a customary alkaline viscose solution. The viscose-coated surface is then treated with an acidic spinning liquid which is customary for viscose precipitation and usually comprises sulfuric acid. Spinning liquid can be in a bath through which the viscose-coated, if appropriate tubular, fiber web runs, or using a nozzle, it is applied to the viscose-coated fiber web. After running through the regeneration and wash baths customary in the production of films from cellulose hydrate, the fiber-reinforced cellulose film is dried. In the end product, the nonwoven fiber fabric is covered on one or both sides with a cellulose layer so that its surface structure is no longer visible.

It the tubular food casing according to the invention is to be used as a sausage casing, it can be further provided on the inside and/or outside with the coatings or impregnations customary therefor. For example, on the inside and/or the outside a barrier layer against oxygen or water vapor can be applied. Depending on the type of the sausage emulsion, an inner coating to improve the peeling behavior or to improve the adhesion between emulsion and casing can also bring advantages. In certain cases, finally, a fungicidal coating on the outside is appropriate. To obtain colored sausage casings, in addition, color pigments, e.g. carbon black or $TiO_2$, can be present in the cellulose layer. The tubular sausage casing can advantageously be traded in the form of "shirred sticks" (shirred sections, one end of which can already be tied) or flattened or rolled up as "spooled goods".

The invention is described in more detail by the following examples. All percentages are percentages by weight, unless stated otherwise.

EXAMPLE 1

Hemp fibers were laid by a conventional process from a paper pulp, in which the cellulose fiber content was from 0.1 to 0.2%, on an inclined screen to form a coarse-structured fiber paper of 21 g/m$^2$. The paper was conducted over heated large-diameter rollers and dried. The dry paper web was then conducted through a vat which contained a 0.8% strength cellulose solution in an 87.7% strength aqueous NMMO solution at a temperature of 95° C. The paper was squeezed slightly and run through a second vat which contained a 15% strength NMMO solution at a temperature of 20° C. The residual NMMO was extracted with pure water in a third vat. Thereafter, the paper was dried again and wound up. The cellulose content of the nonwoven fiber fabric was approximately 1.2%. In the wet state it had a rupture strength (mean of the longitudinal and transverse rupture strength) of from 6.5 to 7 N/mm$^2$ and a rupture strain (mean of longitudinal and transverse elongation at break) of from 7 to 8%, based on the initial length. With a 10 minute treatment in 6% strength sodium hydroxide solution, the nonwoven fiber fabric lost only from 15 to 20% of its strength, and the elongation at break remained unchanged. In the impregnation of the nonwoven fiber fabric with alkaline viscose solution, perfect viscose penetration took place, and the precipitated cellulose hydrate adheres to the fibers very well.

A tube (caliber 75 mm) coated with viscose on the outside having this nonwoven fabric as a reinforcing inner layer achieved a bursting pressure (wet) of 79 kPa, i.e. 15.5% above the customary nominal value; the static extension at 21 kPa was 82.5 mm (permitted range: 80.3 to 83.3 mm). Mechanically shirred tubes could be processed on automatic stuffing machines. The casings were more stable than the standard casings provided with the inner fiber layer conventional hitherto.

EXAMPLE 2

An amount (0.8%) of still water-soluble polyamine-polyamide-epichlorohydrin resin was added to the hemp fiber paper pulp so that the resin content of the dried paper reached approximately 2%. The nonwoven fiber fabric was then produced from this and dried, as described in Example 1. It had a weight of 23.7 g/m$^2$. It was run firstly through a 95° C. solution of cellulose in 87.7% strength NMMO, then through a 10% strength NMMO solution at 20° C. and then through a water vat, dried again and wound up. In the wet state, the rupture strength was from 8 to 9 N/mm$^2$ (mean of longitudinal+transverse) and the rupture strain was from 6 to 6.5%. On alkali treatment, this nonwoven fabric lost only from 12 to 15% of its wet strength, and the rupture strain was unchanged. The nonwoven fiber fabric was shaped to form a tube and impregnated on its outside with alkaline viscose solution. The 90 mm caliber tube obtained after acid precipitation and customary regeneration reached a bursting pressure of 72 kPa, i.e. 17% above the value usually required. The static extension at 21 kPa was 100.5 mm (required range: from 99 to 102 mm). The casings were extraordinarily stable, could be shirred without problem and could be stuffed with sausage mixture on automatic stuffing machines. The stuffing, shrinkage, ripening and peeling behavior were normal.

EXAMPLE 3

Similarly to Example 1, a hemp fiber paper having a weight per unit area of 25.4 g/m$^2$ was produced. It was then run through a 1.2% strength cellulose solution in 87.7% strength aqueous NMMO at 90° C., then precipitated in a 12% strength NMMO solution, washed in a further wash vat, then dried and wound up. The paper, in the wet state, showed a rupture strength of 9 N/mm$^2$ and a rupture strain of 7%.

A 120 mm caliber tube viscose-coated on the outside showed, after the customary precipitation and regeneration, a bursting pressure of 64 kPa, or 18.5% above the required value, and the static extension was 135 mm, at 21 kPa (required range: from 133 to 137 mm). It could be processed without defect.

We claim:

1. A nonwoven fiber fabric whose fibers were bonded by a) treatment with a solution of cellulose in a mixture of N-methylmorpholine N-oxide (NMMO) and water, b) precipitation of the cellulose using an aqueous NMMO solution, c) washing to remove the NMMO and, if appropriate, d) drying.

2. A nonwoven fiber fabric as claimed in claim 1, wherein the cellulose content is from 0.5 to 5% by weight based on its total weight.

3. A nonwoven fiber fabric as claimed in claim 1, wherein the fibers are hemp fibers.

4. A process for producing a bonded nonwoven fiber fabric having the following stages in the sequence specified:

providing a suspension which comprises cellulose fibers, forming a nonwoven fiber fabric from the suspension, partial or complete drying of the nonwoven fabric and bonding of the nonwoven fabric, which comprises, for the purpose of bonding, applying to the nonwoven fabric a solution of cellulose in an NMMO/water mixture, precipitating the cellulose using an aqueous NMMO solution, washing the nonwoven fabric virtually free from NMMO and drying it.

5. The process as claimed in claim 4, wherein the suspension additionally comprises at least one polyamine-polyamide-epichlorohydrin resin, a urea-formaldehyde resin or a melamine-formaldehyde resin.

6. The process as claimed in claim 4, wherein the solution is applied by immersing the nonwoven fabric into a bath containing a cellulose/NMMO/water solution.

7. Teabags comprising the nonwoven fiber fabric as claimed in claim 1.

8. A fiber-reinforced food casing or packaging film produced by the viscose process, wherein the fiber reinforcement consists of a nonwoven fiber fabric as claimed in claim 1.

9. The process for producing the food casing or packaging film as claimed in claim 8, in which a nonwoven fiber fabric is viscose-coated on one or both sides, wherein the nonwoven fiber fabric comprises a nonwoven fiber fabric whose fibers were bonded by a) treatment with a solution of cellulose in a mixture of N-methylmorpholine N-oxide (NMMO) and water, b) precipitation of the cellulose using an aqueous NMMO solution, c) wasing to remove the NMMO and, if appropriate, d) drying.

10. The process as claimed in claim 9, wherein the nonwoven fiber fabric was bent to form a tube prior to the viscose-coating.

11. A nonwoven fiber fabric as claimed in claim 1, wherein the cellulose content is from 1 to 3% by weight based on its total weight.

12. A nonwoven fiber fabric as claimed in claim 1, wherein the cellulose content is from 1.5 to 2% by weight based on its total weight.

13. Reinforced packaging films comprising the nonwoven fiber fabric as claimed in claim 1.

14. Tubular food casings comprising the nonwoven fiber fabric as claimed in claim 1.

* * * * *

UNITED STATES PATENT AND TRADEMARK OFFICE

CERTIFICATE OF CORRECTION

PATENT NO. : 6,048,917
DATED : April 11, 2000
INVENTOR(S) : Klaus-Dieter HAMMER, et al.

It is certified that error appears in the above-identified patent and that said Letters Patent is hereby corrected as shown below:

Title page item [30], "Foreign Application Priority Data" is incorrect. The filing date of the priority application is listed incorrectly.

delete "Oct. 18, 1996" and insert --Sept. 16, 1996--.

Signed and Sealed this

Third Day of April, 2001

*Attest:*

Nicholas P. Godici

NICHOLAS P. GODICI

*Attesting Officer*

*Acting Director of the United States Patent and Trademark Office*